US007598912B2

(12) United States Patent
Lee

(10) Patent No.: US 7,598,912 B2
(45) Date of Patent: Oct. 6, 2009

(54) PLANAR ANTENNA STRUCTURE

(75) Inventor: Gwo-Yun Lee, Taipei (TW)

(73) Assignee: Compal Electronics, Inc., Taipei (TW)

( * ) Notice: Subject to any disclaimer, the term of this patent is extended or adjusted under 35 U.S.C. 154(b) by 0 days.

(21) Appl. No.: 11/309,199

(22) Filed: Jul. 13, 2006

(65) Prior Publication Data

US 2007/0126640 A1 Jun. 7, 2007

(30) Foreign Application Priority Data

Dec. 7, 2005 (TW) ..... 94143096 A

(51) Int. Cl.
*H01Q 1/38* (2006.01)

(52) U.S. Cl. ..... 343/700 MS

(58) Field of Classification Search ..... 343/702, 343/700 MS, 767, 769, 770
See application file for complete search history.

(56) References Cited

U.S. PATENT DOCUMENTS

| | | | | |
|---|---|---|---|---|
| 6,008,764 | A * | 12/1999 | Ollikainen et al. | 343/700 MS |
| 6,195,048 | B1 * | 2/2001 | Chiba et al. | 343/700 MS |
| 6,680,705 | B2 * | 1/2004 | Tan et al. | 343/702 |
| 6,977,616 | B2 * | 12/2005 | Yuanzhu | 343/700 MS |
| 2004/0056804 | A1 * | 3/2004 | Kadambi et al. | 343/700 MS |
| 2004/0155823 | A1 * | 8/2004 | Kossiavas et al. | 343/702 |
| 2005/0140554 | A1 * | 6/2005 | Wang et al. | 343/702 |

FOREIGN PATENT DOCUMENTS

| | | |
|---|---|---|
| JP | 57-075005 | 5/1982 |
| JP | 61-232704 | 10/1986 |
| JP | 07-022832 | 1/1995 |
| JP | 11-317615 | 11/1999 |
| WO | 2005/055364 | 6/2005 |

* cited by examiner

*Primary Examiner*—Hoang V Nguyen
*Assistant Examiner*—Robert Karacsony
(74) *Attorney, Agent, or Firm*—Jianq Chyun IP Office

(57) ABSTRACT

A planar antenna structure including a ground conductor, a first radiating patch, a shorting patch and a second radiating patch is provided. The first radiating patch is disposed above the ground conductor. One end of the shorting patch is connected with the ground conductor, and the other end thereof is connected with one side of the first radiating patch. A projection of the first radiating patch on the ground conductor is located on one side of a projection of the shorting patch on the ground conductor. The second radiating patch is disposed above the ground conductor and the first radiating. A projection of the second radiating patch on the ground conductor traverses both sides of the projection of the shorting patch on the ground conductor. The projection of the second radiating patch on the ground conductor partially overlaps with the projection of the first radiating patch on the ground conductor.

5 Claims, 7 Drawing Sheets

PLANAR ANTENNA STRUCTURE

CROSS-REFERENCE TO RELATED APPLICATION

This application claims the priority benefit of Taiwan application serial no. 94143096, filed on Dec. 7, 2005. All disclosure of the Taiwan application is incorporated herein by reference.

BACKGROUND OF THE INVENTION

1. Field of the Invention

The present invention generally relates to an antenna structure, and more particularly, to a planar antenna structure built in an electronic device.

2. Description of Related Art

In keeping pace with progress in telecommunication technology, application of the telecommunication technology for hi-tech products has been increasing and related telecommunication products have become diversified. In recent years, the consumer functional requirements for telecommunication products have become increasingly higher; therefore, telecommunication products with various designs and functions are continuously brought to market, and the computer network products with wireless networks are in demand.

Since antenna design affects the communication quality of communication products, it is the key factor of communication products. Generally, antennas comprise internal antennas and external antennas. External antennas comprise monopole antennas, dipole antennas and helix antennas. Internal antennas comprise planar inverted F antennas (PIFA) and microstrip antennas. The PIFA is widely used in communication products.

FIG. 1 is a three-dimensional diagram showing a conventional PIFA. FIG. 2 is a side view showing the conventional PIFA as shown in FIG. 1. Please refer to FIGS. 1 and 2, the conventional PIFA 100 comprises a ground conductor 110, a radiating patch 120, a shorting patch 130 and a feeding patch 140. The radiating patch 120 is disposed above the ground conductor 110, and the ground conductor 110 is parallel with the radiating patch 120 with a suitable distance, and the radiating patch 120 has a feed point FP. In addition, one end of the shorting patch 130 is connected to the ground conductor 110, and the other end of the shorting patch 130 is connected to one side of the radiating patch 120. Further, one end of the feeding patch 140 is connected to the FP on the radiating patch 120, and the other end is electrically connected to a signal source SS.

For achieving the performance of dual-frequency antenna, a groove 124 may be additionally formed on the radiating patch 120 of the PIFA 100 in order to divide the radiating patch 120 into an outer first radiating part 120*a* and an inner second radiating parch 120*b*. The first radiating part 120*a* and the second radiating part 120*b* may serve as a first radiator of a first frequency band and a second radiator of a second frequency band, respectively, for operating in two different operation frequencies.

FIG. 3 is a radiation pattern of the PIFA shown in FIG. 1 at 2.45 GHz during operation; FIG. 4 is a radiation pattern of the PIFA shown in FIG. 1 at 5.25 GHz during operation. From FIGS. 3 and 4, the beam width of the conventional PIFA is narrower. It means that the signal receiving/transmitting area of the PIFA is limited to a smaller region above the radiating patch. Accordingly, how to increase the signal receiving/transmitting area of the PIFA is an important issue.

SUMMARY OF THE INVENTION

To achieve the above and other objects, the present invention is directed to a planar antenna structure for increasing the signal receiving/transmitting area.

The present invention is also directed to a planar antenna structure for receiving and transmitting signals in two different frequency bands.

As embodied and broadly described herein, the present invention provides a planar antenna structure comprising a ground conductor, a first radiating patch, a shorting patch and a second radiating patch. The first radiating patch is disposed above the ground conductor and has a feed point. One end of the shorting patch is connected to the ground conductor, the other end of the shorting patch is connected to one side of the first radiating patch, and a projection of the first radiating patch on the ground conductor is located on one side of a projection of the shorting patch on the ground conductor. The second radiating patch is disposed above the ground conductor and the first radiating patch, a projection of the second radiating patch on the ground conductor traverses both sides of the projection of the shorting patch on the ground conductor, and the projection of the second radiating patch on the ground conductor partially overlaps with the projection of the first radiating patch on the ground conductor.

According to an embodiment of the present invention, the first radiating patch is parallel with the second radiating patch.

According to an embodiment of the present invention, the ground conductor is a ground metal sheet.

According to an embodiment of the present invention, the ground conductor is a ground plane of a printed circuit board.

According to an embodiment of the present invention, the planar antenna structure further comprises a feed patch. One end of the feed patch is connected to the feed point, and the other end of the feed patch is electrically connected to a signal source.

According to an embodiment of the present invention, the planar antenna structure further comprises a feed line. One end of the feed line is connected to the feed point, and the other end of the feed line is electrically connected to a signal source.

According to an embodiment of the present invention, the first radiating patch has a first groove for dividing the first radiating patch into a first radiating portion and a second radiating portion, and the second radiating patch has a second groove for dividing the second radiating patch into a third radiating portion and a fourth radiating portion. A first radiating body capable of operating at a first frequency band comprises the first radiating portion and the third radiating portion, and a second radiating body capable of operating at a second frequency band comprises the second radiating portion and the fourth radiating portion.

According to an embodiment of the present invention, the feed point is surrounded by the first groove and both ends of the first groove end at one side where the first radiating patch is connected with the shorting patch.

According to an embodiment of the present invention, both ends of the second groove end at one side where the second radiating patch is adjacent to the first radiating patch.

In light of the above, the second radiating patch serving as a parasitic antenna is additionally arranged above the ground conductor and the first radiating patch, such that the signal receiving/transmitting area of the planar antenna structure can be increased by the second radiating patch.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
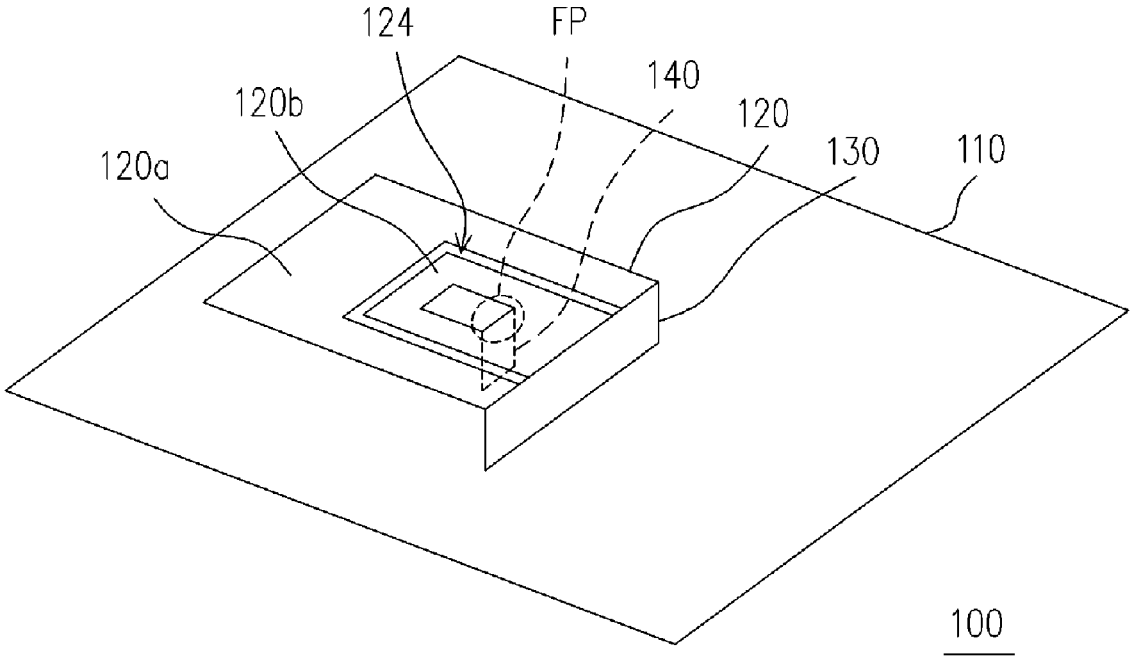
FIG. 1 (PRIOR ART)
FIG. 1 is a three-dimensional diagram showing a conventional PIFA.
Figure 2:
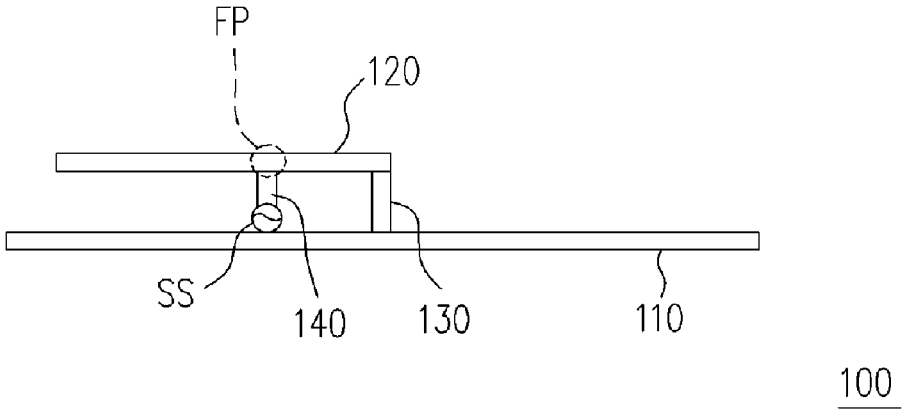
FIG. 2 (PRIOR ART)
FIG. 2 is a side view showing the conventional PIFA as shown in FIG. 1.

Reference will now be made in detail to the present preferred embodiments of the invention, examples of which are illustrated in the accompanying drawings. Wherever possible, the same reference numbers are used in the drawings and the description to refer to the same or like parts.

Figure 5:
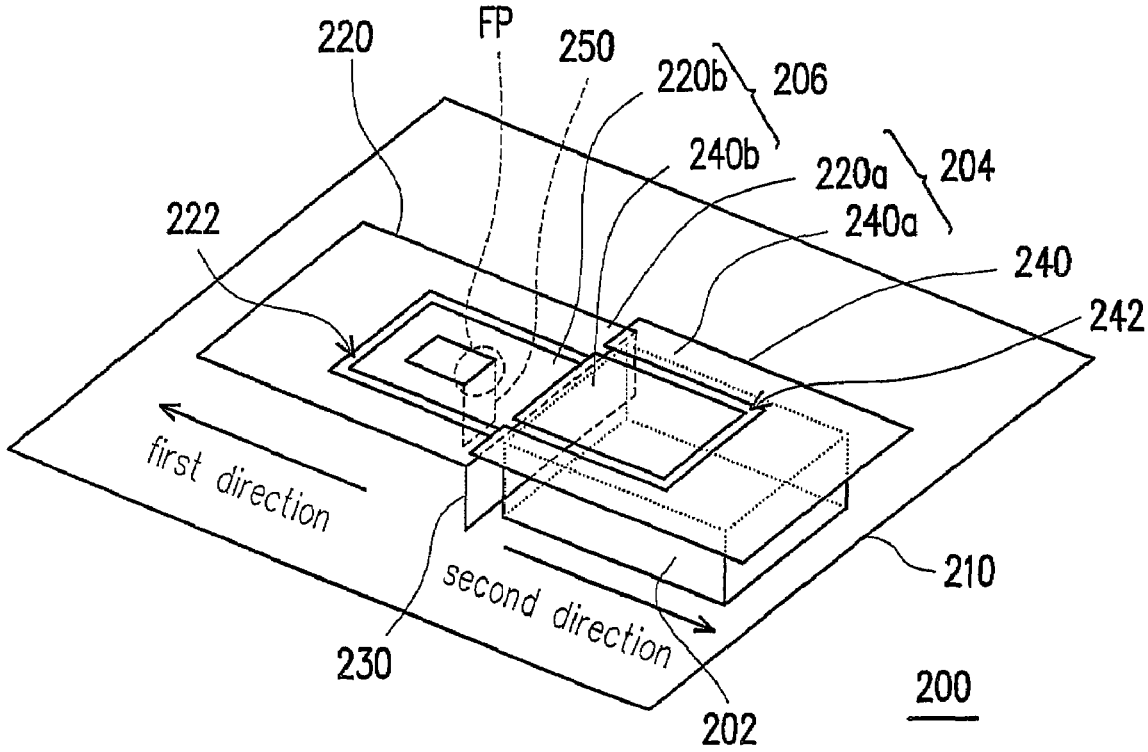
FIG. 5 is a three-dimensional diagram showing a planar antenna structure according to an embodiment of the present invention.
Figure 6:
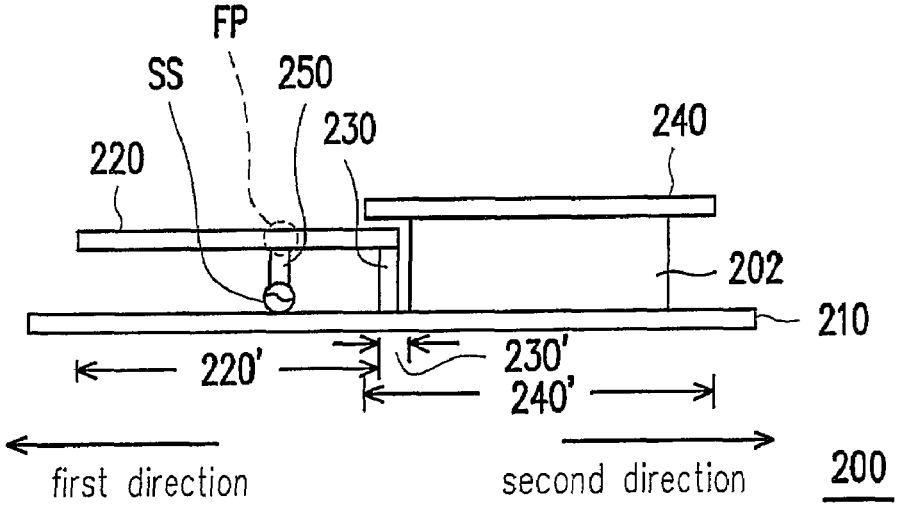
FIG. 6 is a side view showing the planar antenna structure as shown in FIG. 5.

FIG. 5 is a three-dimensional diagram showing a planar antenna structure according to an embodiment of the present invention. FIG. 6 is a side view showing the planar antenna structure as shown in FIG. 5. Referring to FIGS. 5 and 6, the planar antenna structure 200 of the present embodiment comprises a ground conductor 210, a first radiating patch 220, a shorting patch 230 and a second radiating patch 240. The ground conductor 210 may be a ground metal sheet or a ground plane of a printed circuit board. Besides, the first radiating patch 220 is disposed above the ground conductor 210 and has a feed point FP. In addition, one end of the shorting patch 230 is connected to the ground conductor 210, and the other end of the shorting patch 230 is connected to the first radiating patch 220.

In this embodiment, the first radiating patch 220 may be parallel with the second radiating patch 240, and the sum of the distance between the first radiating patch 220 and the ground conductor 210 and the distance between the first radiating patch 220 and the second radiating patch 240 is equal to the distance between the second radiating patch 240 and the ground conductor 210.

In this embodiment, the second radiating patch 240 above the first radiating patch 220 may be supported by a non-metallic support 202, and the non-metallic support 202 can be made of an insulating material such as polystyrene plastic and so on.

It should be noted that a projection 220' of the first radiating patch 220 on the ground conductor 210 is located on one side of a projection 230' of the shorting patch 230 on the ground conductor 210. A projection 240' of the second radiating patch 240 on the ground conductor 210 traverses both sides of the projection 230' of the shorting patch 230 on the ground conductor 210. The projection 240' of the second radiating patch 240 on the ground conductor 210 partially overlaps with the projection 220' of the first radiating patch 220 on the ground conductor 210. Accordingly, the first radiating patch 220 and the second radiating patch 240 may transmit signal to each other by radiating electromagnetic wave, such that the signal receiving/transmitting area of the planar antenna structure 200 may be increased.

In this embodiment, the planar antenna structure 200 further comprises a feed patch 250 for electrically connecting to a signal source SS. One end of the feed patch 250 is connected to the feed point FP of the first radiating patch 220, and the other end of the feed patch 250 is electrically connected to the signal source SS. Thus, the signal source SS may transmit signals to the first radiating patch 220 through the feed patch 250, such that the first radiating patch 220 may transmit signals in the form of electromagnetic waves. In addition, the above-mentioned feed patch 250 may be replaced by a feed line (not shown). Similarly, one end of the feed line is connected to the feed point FP, and the other end of the feed line is electrically connected to the signal source SS. When a coaxial cable is used as the feed line, one end of the core conductor for signal transmission is connected to the feed point FP, and one end of the outer conductor for signal shielding is connected to the ground conductor 210.

Referring to FIG. 5, in order to provide the function of receiving and transmitting signals in two different frequency bands, the first radiating patch 220 of this embodiment may further have a first groove 222 for dividing the first radiating patch 220 into an outer first radiating portion 220*a* and an inner second radiating portion 220*b*. In this embodiment, the feed point FP is surrounded by the first groove 222 and both ends of the first groove 222 end at one side where the first radiating patch 220 is connected with the shorting patch 230. Additionally, the second radiating patch 240 may further have a second groove 242 for dividing the second radiating patch 240 into an outer third radiating portion 240*a* and an inner fourth radiating portion 240*b*. In this embodiment, both ends of the second groove 242 end at one side where the second radiating patch 240 is adjacent to the first radiating patch 220.

Figure 7:
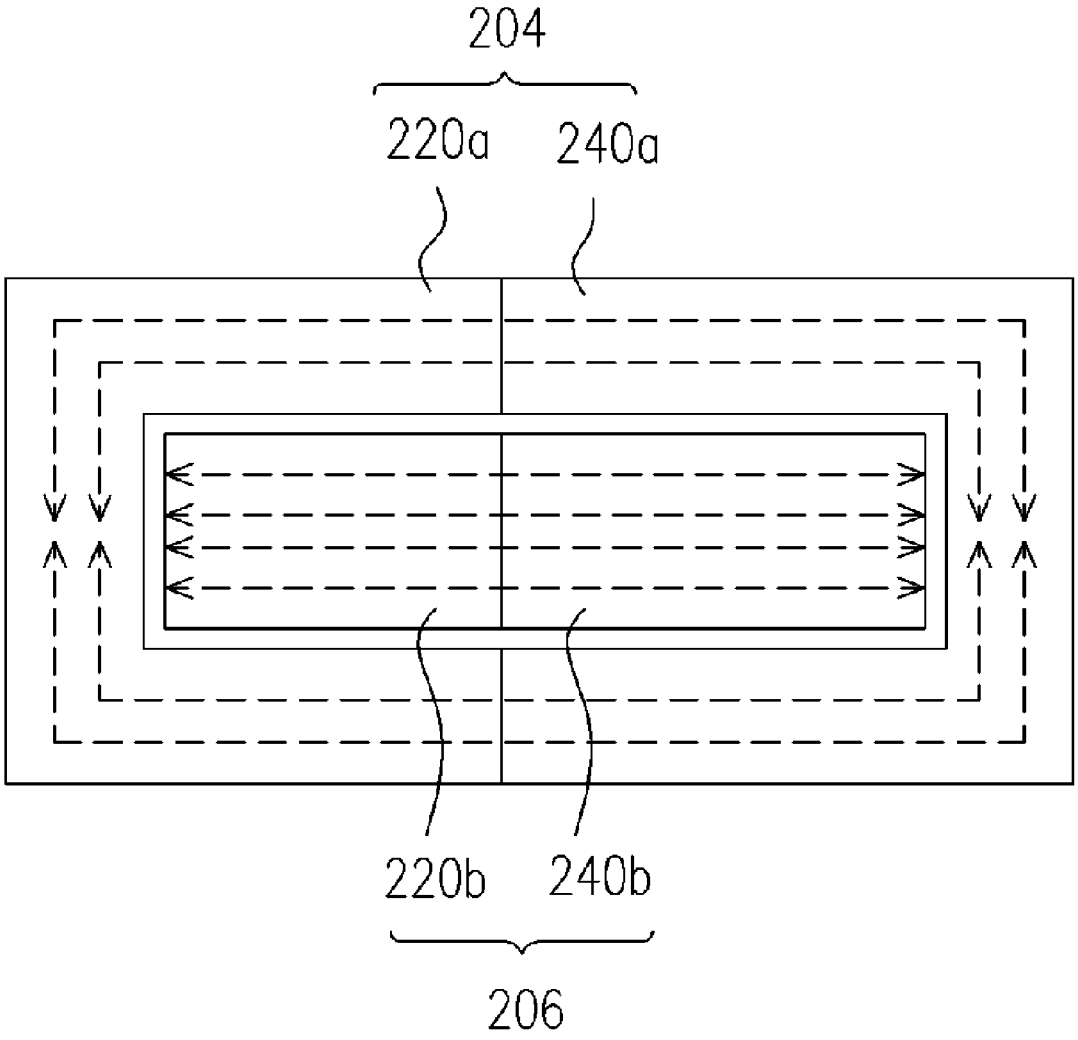
FIG. 7 is a schematic diagram showing the current path in the first and second radiators as shown in FIG. 5.

FIG. 7 is a schematic diagram showing the current path in the first and second radiators as shown in FIG. 5. Referring to FIGS. 5 and 7, a first radiator 204 of a first frequency band comprises the outer first radiating portion 220*a* and the third radiating portion 240*a*, and a second radiator 206 of a second frequency band comprises the inner second radiating portion 220*b* and the fourth radiating portion 240*b*. Accordingly, the first radiator 204 operating at the first frequency band and the second radiator 206 operating at the second frequency band of the planar antenna structure 200 may be applied to signal transmission in two different frequency bands. It should be noted that the frequency band of the first radiator 204 is determined by the length of the current path thereof, and the frequency band of the second radiator 206 is determined by the length of the current path thereof.

In order to compare the radiation pattern of the planar antenna structure with that of the conventional PIFA 100 as shown in FIG. 1, the first radiator 204 as shown in FIG. 5 is set to operate at 2.45 GHz, and the second radiator 206 as shown in FIG. 5 is set to operate at 5.25 GHz.

Figure 3:
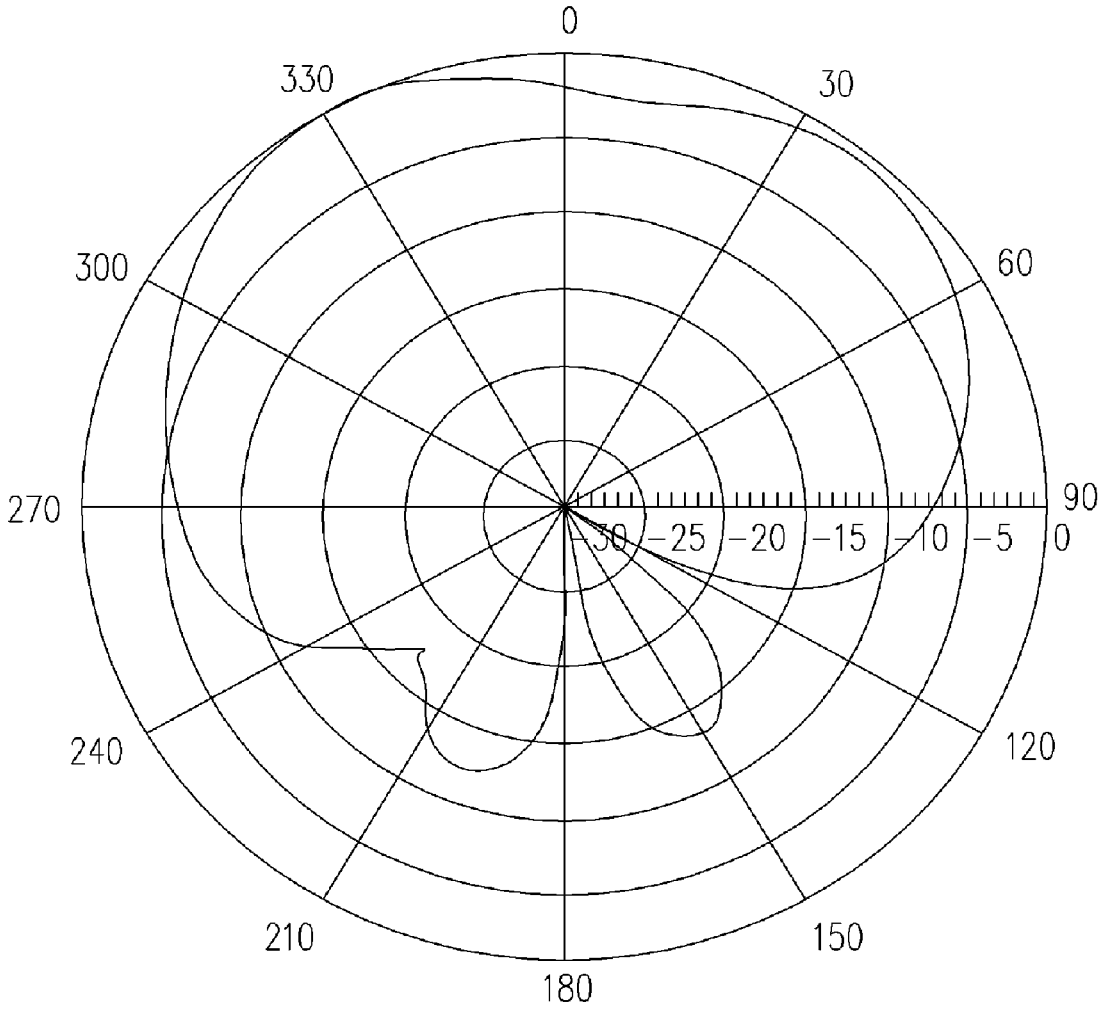
FIG. 3 (PRIOR ART)
FIG. 3 is a radiation pattern of the PIFA shown in FIG. 1 at 2.45 GHz during operation.
Figure 8:
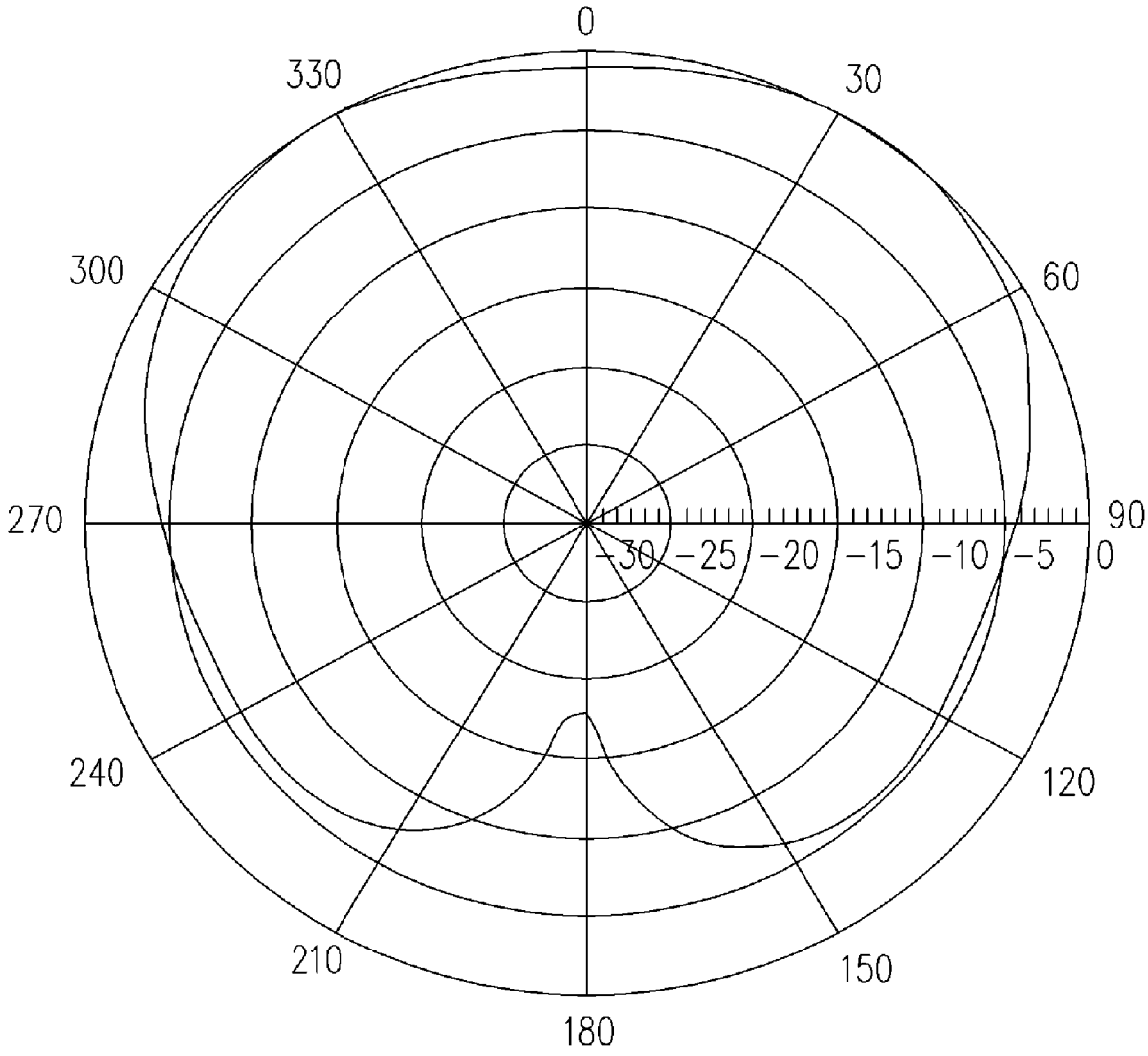
FIG. 8 is a radiation pattern of the planar antenna structure shown in FIG. 5 at 2.45 GHz during operation.

FIG. 8 is a radiation pattern of the planar antenna structure shown in FIG. 5 at 2.45 GHz during operation. Please refer to FIGS. 3 and 8, the conventional PIFA 100 has a narrower beam width when operating at 2.45 GHz. On the contrary, the planar antenna structure 200 has a broader beam width when operating at 2.45 GHz.

Figure 4:
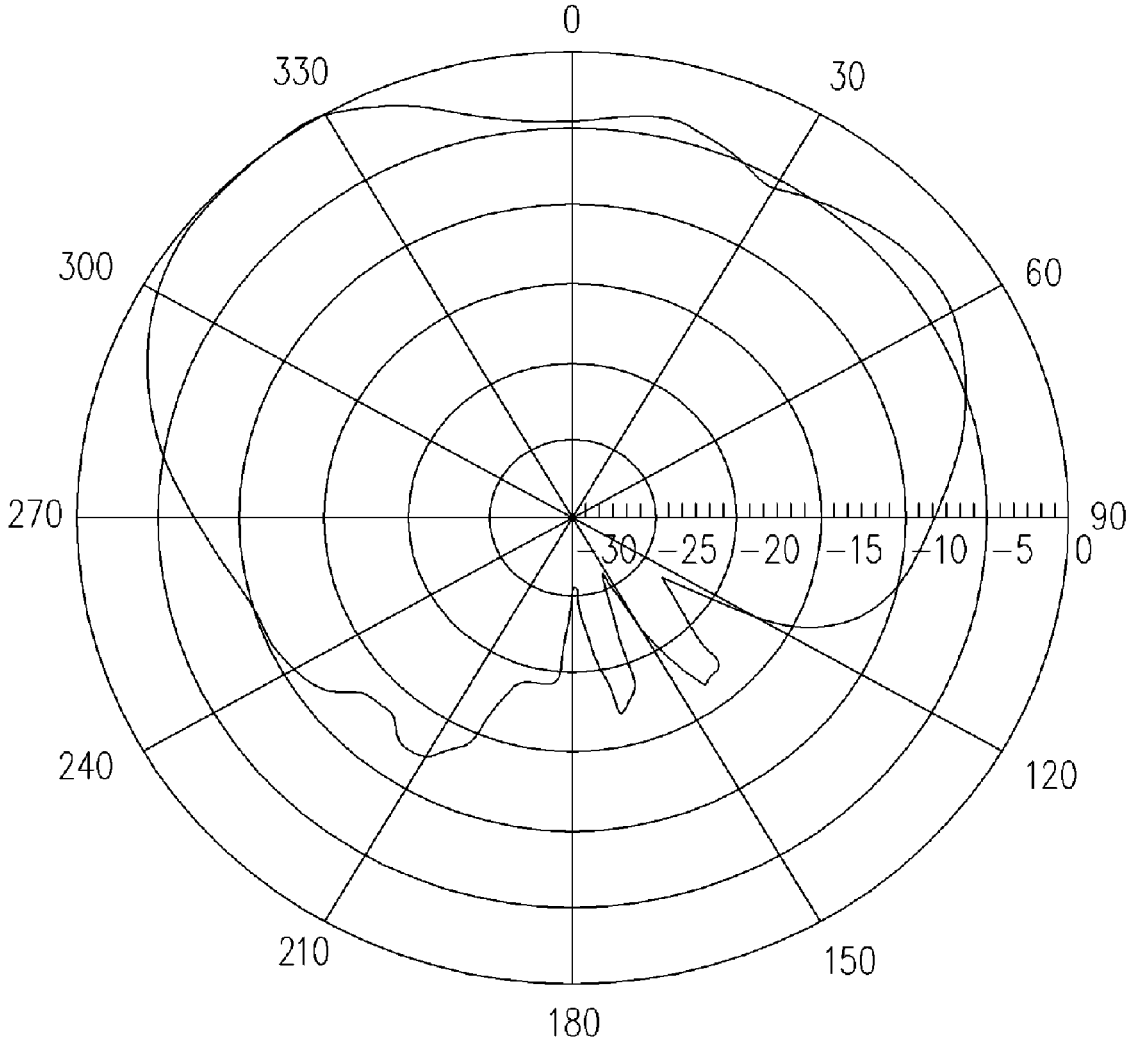
FIG. 4 (PRIOR ART)
FIG. 4 is a radiation pattern of the PIFA shown in FIG. 1 at 5.25 GHz during operation.
Figure 9:
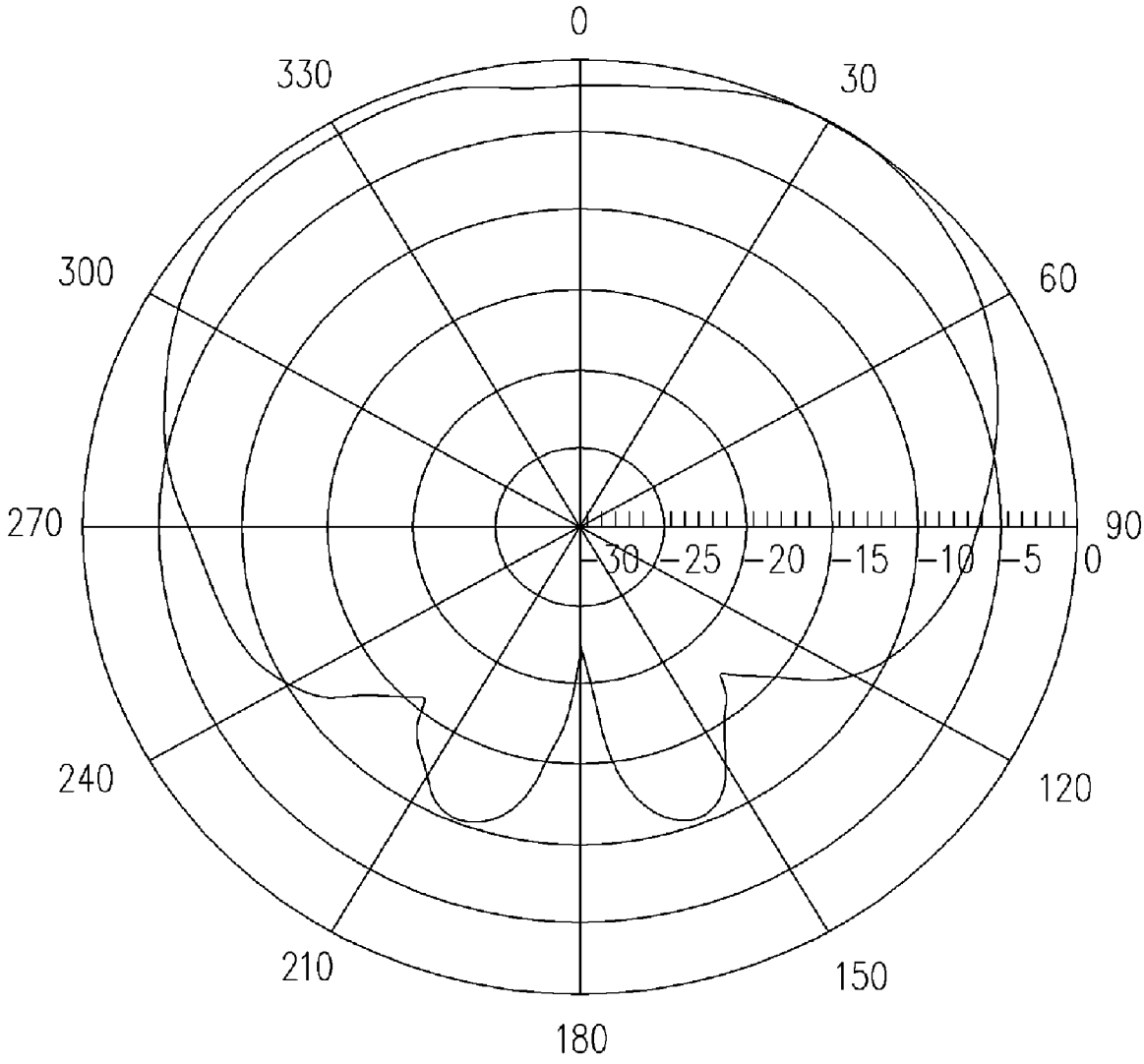
FIG. 9 is a radiation pattern of the planar antenna structure shown in FIG. 5 at 5.25 GHz during operation.

FIG. 9 is a radiation pattern of the planar antenna structure shown in FIG. 5 at 5.25 GHz during operation. Please refer to FIGS. 4 and 9, the conventional PIFA 100 has a narrower beam width when operating at 5.25 GHz; the planar antenna structure 200 has a broader beam width when operating at 5.25 GHz.

In summary, the second radiating patch serving as a parasitic antenna is additionally arranged above the ground conductor and the first radiating patch, such that the signal receiving/transmitting area of the planar antenna structure can be increased by the second radiating patch. Additionally, the present invention may further divide the first radiating patch and the second radiating patch into several parts in order to constitute the first radiator and the second radiator, such that the planar antenna structure may receive and transmit signals in two different frequency bands.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A planar antenna structure comprising:

a ground conductor;

a shorting patch, substantially perpendicularly disposed on the ground conductor and dividing a space above the ground conductor into a first side and a second side;

a first radiating patch, disposed above the ground conductor and having a feed point, the first radiating patch having an end connected with a top end of the shorting patch and extending in a first direction beginning at the shorting patch in the first side; and a second radiating patch, disposed above the ground conductor, the first radiating patch and the shorting patch, and substantially extending in a second direction beginning at the shorting patch in the second side, wherein the second direction is opposite to the first direction, the second radiating patch partially overlays above the first radiating patch, and the second radiating patch is not electrically coupled to the ground conductor and functions as a parasitic antenna.

2. The planar antenna structure according to claim 1, wherein the second radiating patch is supported by an insulating support on the ground conductor.

3. The planar antenna structure according to claim 1, wherein the first radiating patch has a first groove for dividing the first radiating patch into a first radiating portion and a second radiating portion, and the second radiating patch has a second groove for dividing the second radiating patch into a third radiating portion and a fourth radiating portion, such that, a first radiating body is formed, capable of operating at a first frequency band, comprising the first radiating portion and the third radiating portion, and a second radiating body is formed, capable of operating at a second frequency band, comprising the second radiating portion and the fourth radiating portion.

4. The planar antenna structure according to claim 3, wherein the feed point is surrounded by the first groove and two ends of the first groove end at one side where the first radiating patch is connected with the shorting patch.

5. The planar antenna structure according to claim 4, wherein two ends of the second groove end at one side where the second radiating patch is adjacent to the first radiating patch.

* * * * *